United States Patent [19]

Nagai et al.

[11] Patent Number: 4,968,964

[45] Date of Patent: Nov. 6, 1990

[54] HIGH TEMPERATURE SIC THIN FILM THERMISTOR

[75] Inventors: Takeshi Nagai, Kitakatsuragi; Masahiko Itoh, Nara, both of Japan

[73] Assignee: Matsushita Electric Industrial Co., Ltd., Osaka, Japan

[21] Appl. No.: 340,672

[22] Filed: Apr. 20, 1989

[30] Foreign Application Priority Data

Apr. 21, 1988 [JP] Japan ..... 63-98633

[51] Int. Cl.[5] ..... H01C 7/10

[52] U.S. Cl. ..... 338/22 R; 338/225 D; 338/307

[58] Field of Search ..... 338/22 R, 225 D, 307, 338/308, 309, 28; 374/185, 205

[56] References Cited

U.S. PATENT DOCUMENTS 4,359,372 11/1982 Nagai et al. ..... 338/22 R X 4,424,507 1/1984 Nagai et al. ..... 338/22 R

FOREIGN PATENT DOCUMENTS 2061002 5/1981 United Kingdom .

*Primary Examiner*—Bruce A. Reynolds

*Assistant Examiner*—Marvin M. Lateef

*Attorney, Agent, or Firm*—Wenderoth, Lind & Ponack

[57] ABSTRACT

A thin film thermistor which includes an insulating substrate (21A), a Au-Pt fired electrode film (22A) in a particular comb-shaped pattern on the insulating substrate, with a little amount of oxide being added in the electrode film (22A), and a SiC thin film (23A) which is formed by sputtering on the substrate (21A) on which the electrode film (22A) is previously formed.

12 Claims, 6 Drawing Sheets

| | Conventional Au-Pt fired electrode film | Au-Pt fired electrode film according to the invention |
|---|---|---|
| Before the annealing |  |  |
| After the annealing at 825°C for 6h in air. |  |  |

10μm

SEM (Scanning Electron Micro-scopy) images of the Au-Pt fired electrode films.

interface impedance

SiC film impedance

HIGH TEMPERATURE SIC THIN FILM THERMISTOR

BACKGROUND OF THE INVENTION

1. Field of the Invention

This invention relates to a high temperature SiC thin film thermistor using a sputtered SiC film as a temperature sensitive resistor. In particular, the thermistor can detect temperatures over a wide range of 0°-500° C.

2. Description of the Prior Art

There have been practically used many temperature sensors comprising metals, metal oxides and other materials. In a cooking oven with a pyrolytic self-cleaning function, there has particularly been desired a high performance temperature sensor. Since the above oven operates in the cooking temperature range of 50°-300° C. and in the pyrolytic self-cleaning temperature range of 450°-500° C., the temperature sensor is required to detect temperatures over a wide range of 0°-500° C.

Wires or films of Pt are one example of the most useful temperature sensitive elements. They are disclosed in U.S. Pat. Nos. 3,845,443, 4,222,025 and 4,375,056. Because of its superior thermal stability and higher accuracy, the Pt element can detect temperatures accurately over a wide range of 0°-600° C. However, it is disadvantageous in that its temperature sensitivity is low because of the low temperature coefficient of resistance, which is in the order of about 0.38° %/C.

On the other hand, a conventional thermistor comprising a mixture of various metal oxides such as Fe, Ni, Co and the like is frequently used as a temperature sensor. This conventional thermistor has a high sensitivity, but, in general, its thermal stability is less than 300° C. In addition to the metal oxide thermistor, there are various high temperature thermistors comprising a mixture of $Al_2O_3$ and $Cr_2O_3$, a pyrolytic polycrystalline SiC and others. They are described in U.S. Pat. Nos. 3,958,209, 4,086,559 and 4,208,449. These thermistors have good thermal stability in the higher temperature range above 500° C. However, when they are used in the temperature range lower than 300° C., resistance thereof becomes too high to be practically used because of their high B constant, which is more than 4000K.

Since the SiC thin film thermistor has a unique characteristic in that the B constant increases linearly with an increase of temperature in the range of about 2000K-4000K, as described in J. Phy. E, 15,520 (1982), it can detect temperature over a wide range. However, the thermistor can not operate at a high temperature of 500° C. for a long time because of its poor thermal stability.

SUMMARY OF THE INVENTION

An object of the present invention is to provide a SiC thin film thermistor, which can operate at a high temperature of 500° C. for a long time.

Another object of the present invention is to provide a stabilizing method of the SiC thin film thermistor.

According to one aspect of the present invention, there is provided a SiC thin film thermistor element comprising a sputtered SiC thin film formed on one surface of an insulating substrate, on which a Au-Pt electrode film is previously fired in a comb shape. The Au-Pt fired electrode film includes a little amount of oxides in addition to Au, Pt and glass ($SiO_2$). In general, after the thermistor element is tested at a high temperature, the resistance increases and the B constant decreases. This changes in the resistance and B constant is attributed to an aggregation of the fired electrode film, which results in a growth of a high interface impedance layer between the electrode film and SiC film during test at a high temperature. Since a conventional electrode film easily aggregates, the high interface impedance layer also easily grows. This is the reason why the conventional thermistor element can not operate over a temperature of 400° C. even if the thermistor element is covered with a protective glass layer. The Au-Pt fired electrode film according to the present invention including a little amount of oxide is difficult to aggregate at a high temperature of 500° C. This advanced electrode film raises the operating temperature of the thermistor to a high temperature of 500° C.

BRIEF DESCRIPTION OF THE DRAWINGS

These and other objects and features of the present invention will become clear from the following description taken in conjunction with the preferred embodiments thereof with reference to the accompanying drawings, in which:

FIG. 7 is a perspective view similar to FIG. 1, which particularly relates to a conventional thermistor.

DESCRIPTION OF THE PREFERRED EMBODIMENT

Figure 1:
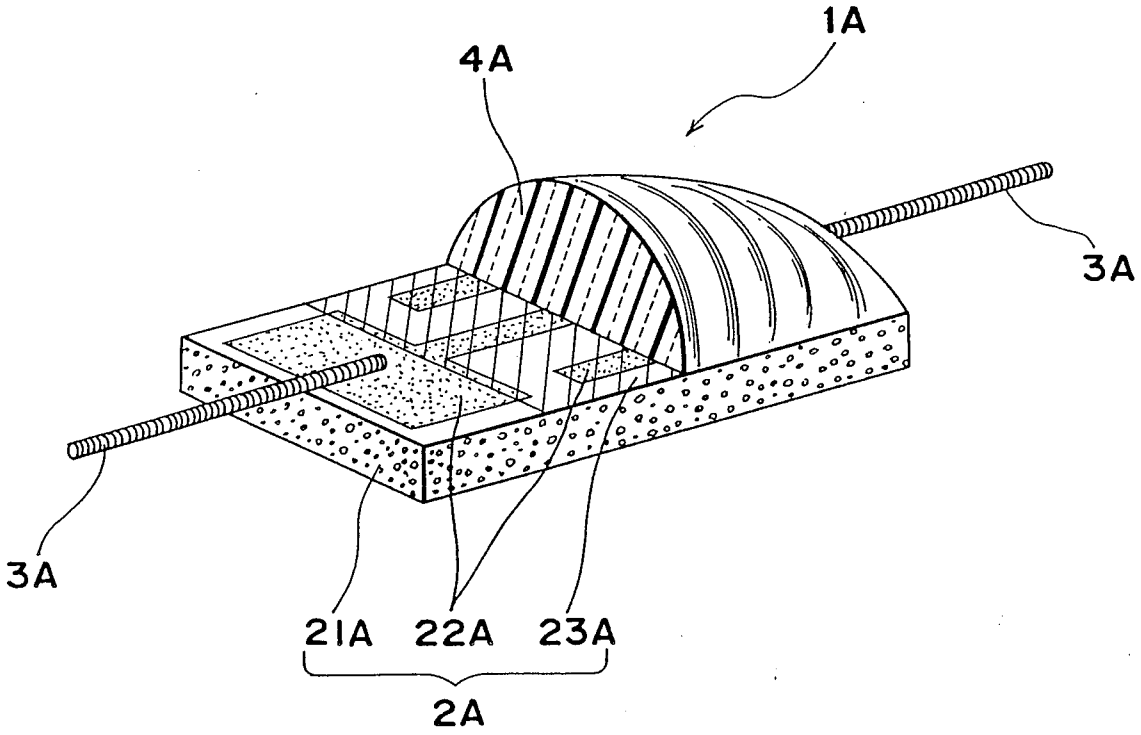
FIG. 1 is a perspective view showing a schematic construction of a practical SiC thin film thermistor according to one preferred embodiment of the present invention.

Before the description of the present invention proceeds, it is to be noted that like parts are designated by like reference numerals throughout the accompanying drawings.

Referring now to FIG. 1, there is schmetically shown construction of a practical SiC thin film thermistor 1A according to one preferred embodiment of the present invention. The practical thermistor 1A comprises a thermistor element 2A, leads 3A and a protective glass layer 4A. The thermistor element 2A includes a sputtered SiC thin film 23A formed on one surface of an insulating substrate 21A, on which a fired electrode film 22A was previously formed in a comb shape. An alumina substrate was used hereinafter as the insulating substrate 21A. The alumina substrate 21A was 2-3 μm in surface roughness and about 95% in purity. A Au-Pt fired electrode film was used for the fired electrode film 22A. The Au-Pt fired electrode film 22A will be described in detail hereinafter because the thermal stability of the thermistor element 2A depended on the electrode film 22A. The SiC film 23A was formed by using a planar rf-sputtering apparatus under the following conditions.

| | |
|---|---|
| Frequency | 13.56 MHz |
| Target | SiC ceramic |
| Distance(1) | About 35 mm |
| Sputtering gas | Ar gas |
| Sputtering pressure | $(2-3)\times 10^{-2}$ torr |
| Sputtering time | About 2 hours |
| Rf-power | About 4 W/cm$^2$ |
| Substrate temperature | About 700° C. |

(1)Between the alumina substrate 21A and the target.

The SiC film 23A was about 1.6 μm in thickness. The method of preparing the sputtered SiC film is described in detail in U.S. Pat. No. 4,359,372, and reference should be made thereto for details thereof. After the thermistor element 2A was formed, leads 3A were connected and the protective glass layer 4A was formed to protect the thermistor element 2A from humidity and dust. The practical SiC thin film thermistor 1A was completed by the processes as described hereinbefore.

The effect of the Au-Pt fired electrode film 22A on the thermal stability of the thermistor element 2A will be described in detail hereinafter.

In a conventional SiC thin film thermistor 1B as shown in FIG. 7, the known Au-Pt fired electrode film 22B was formed in a manner as follows. A Au-Pt paste was used to be printed on one surface of the alumina substrate 21B in a particular comb-shaped pattern. After drying the printed alumina substrate 21B, it was fired or calcined at a high temperature of 900°-1000° C. in air. The conventional Au-Pt fired electrode film 22B includes Au, Pt and glass ($SiO_2$). Glass ($SiO_2$) is required to rigidly bond Au and Pt to the alumina substrate 21B. The amount of glass was about 10 wt % based on the sum of Au and Pt in weight. It has been found that an addition of a small amount of oxides to the conventional Au-Pt fired electrode film 22B, besides $SiO_2$, increases the thermal stability of the thermistor element 2B. In the following description, the thermistor element of the present invention is defined as the thermistor element 2A using the Au-Pt fired electrode film 22A wherein a small amount of oxides is added according to the present invention. The conventional thermistor element is defined as the thermistor element 2B using the conventional Au-Pt fired electrode film 22B.

Figure 2:
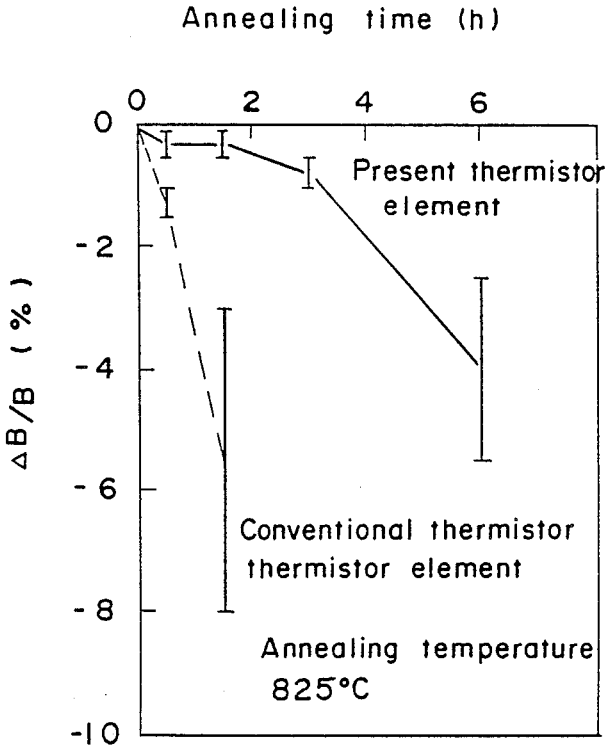
FIG. 2 is a characteristic diagram showing an effect of the Au-Pt fired electrode film according to the present invention on the stability of the B constant in an annealing at 825° C. in air in comparison with that of the conventional Au-Pt fired electrode film.

FIG. 2 is a diagram showing the relation of the rate of B constant change (ΔB/B) with respect to lapse of annealing time in annealing of the thermistor elements 2A and 2B at 825° C. in air. In the thermistor element 2A of the present invention, there was added a mixture of Ca oxide and Ti oxide in an amount of about 0.1 wt % based on the sum of Au and Pt in weight. The SiC thin films 23A and 23B of both of the thermistor elements 2A and 2B were formed in the same sputtering process to eliminate the distribution of the thermal stability from sputtering to sputtering. Before the annealing, the B constant of both of the thermistor elements 2A and 2B ranged from 2400-2450K. The B constant was calculated from the equation $\ln(R_1/R_2)/1/T_1-T_2)$, where $R_1$ and $R_2$ were the measured DC resistances at $T_1$ (50° C.=323K) and $T_2$ (160° C.=433K), respectively. It was found from FIG. 2 that the present thermistor element 2A is more stable than the conventional thermistor element 2B.

Figure 3A:
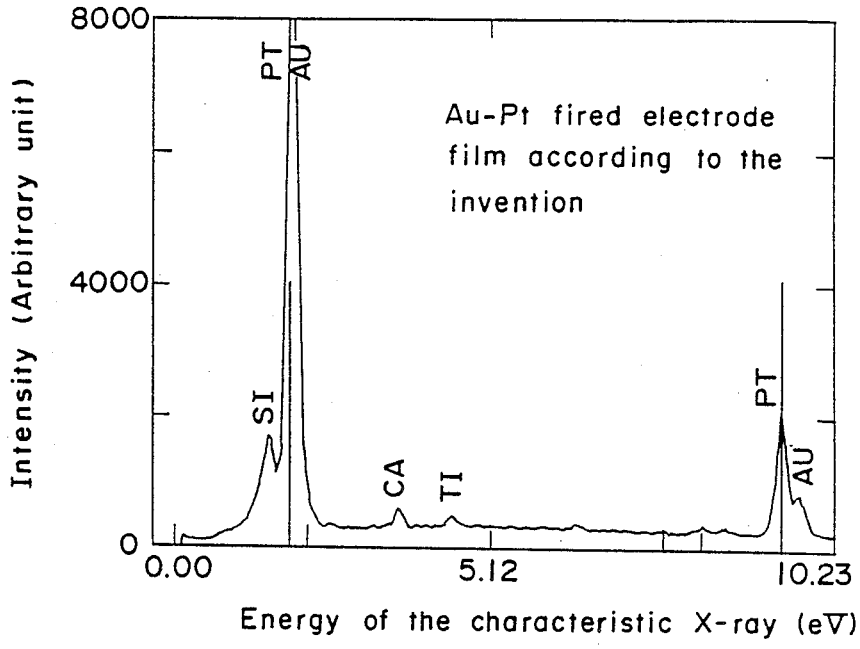
FIGS. 3(A) and 3(B) are graphs showing examples of composition analysis of the Au-Pt fired electrode film according to the present invention in comparison with that of the conventional Au-Pt fired electrode film.
Figure 3B:
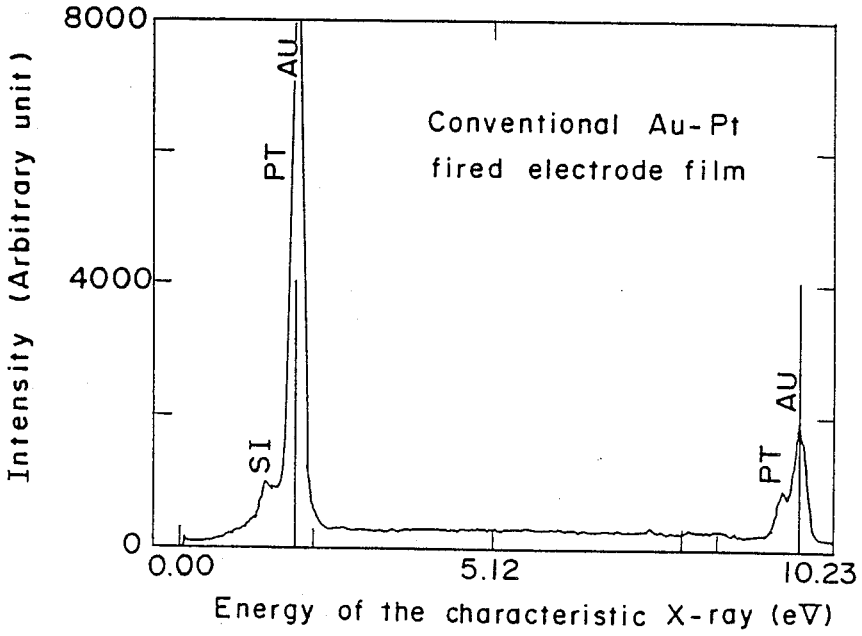

FIGS. 3(A) and 3(B) show examples of composition analyses of the Au-Pt fired electrode films 22A and 22B by XMA (X-ray Micro-Analyzer). The Au-Pt fired electrode film 22A of the present invention includes Ca and Ti in addition to Au, Pt and Si (one of the main components of glass) which are included in the conventional Au-Pt fired electrode film 22B. From FIGS. 3(A) and 3(B) it is not clear whether Ca and Ti are in the state of oxides or not. However, since the present and conventional Au-Pt fired electrode films 22A and 22B were formed by firing at high temperatures in air as described hereinbefore, it is reasonable that Ca and Ti are in the state of oxides.

Figure 4:
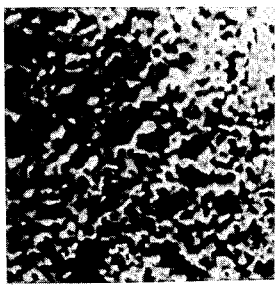
FIG. 4 shows SEM images of the surface structure of the Au-Pt fired electrode film according to the present invention in comparison with those of the conventional Au-Pt fired electrode film.
Figure 4:
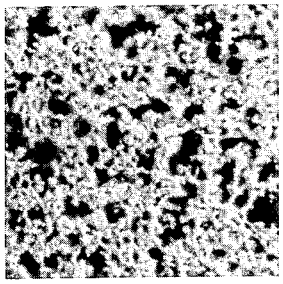
Figure 4:
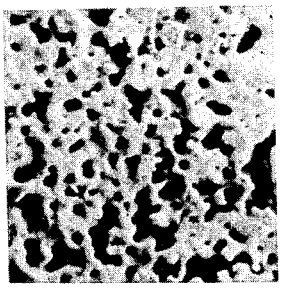
Figure 4:
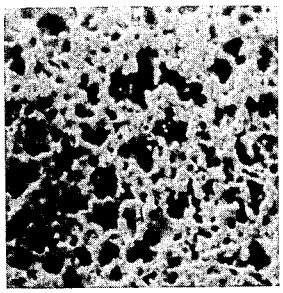

The surface structure of the Au-Pt fired electrode films 22A and 22B was analyzed before and after the annealing at 825° C. for 6 hours in air to find the reason why the Au-Pt fired electrode film 22A according to the present invention increased the thermal stability of the thermistor element 2A. FIG. 4 shows SEM (Scanning Electron Microscopy) images of the Au-Pt fired electrode films 22A and 22B before and after the annealing. It was found that the Au-Pt fired electrode film 22A according to the present invention aggregated to a much smaller extent than the conventional Au-Pt fired electrode film 22B.

Figure 5:
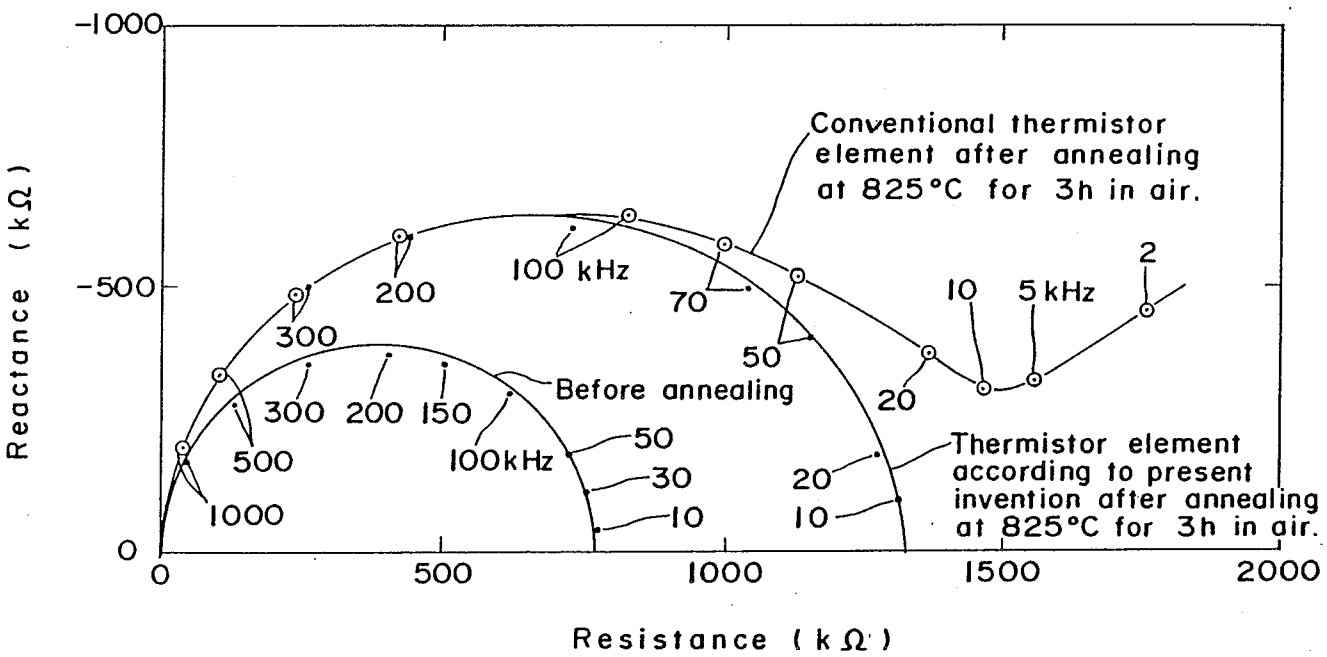
FIG. 5 shows Cole-Cole plots representing the effect of the Au-Pt fired electrode film according to the present invention on the complex impedance of the thermistor element after annealing at 825° C. for 6 hours in air in comparison with that of the conventional Au-Pt fired electrode film.
Figure 6:
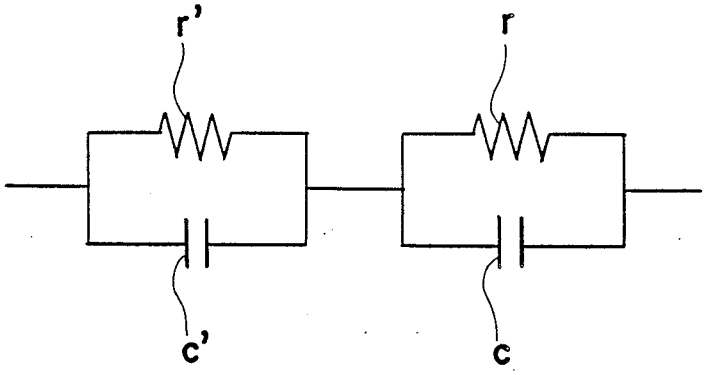
FIG. 6 is an equivalent electric circuit of the thermistor element.

FIG. 5 shows the typical Cole-Cole plots of the various thermistor elements 2A and 2B before and after the annealing at 825° C. for 3 hours in air. Before the annealing, the thermistor elements 2A and 2B had almost the same resistance and B constant. After the annealing, the present thermistor element 2A showed resistance increase of about 70%, and reduction of the B constant of about −1%. However, after the annealing, the resistance of the conventional thermistor element 2B increased more than 5 times, with reduction of the B constant of more than about −10%. The Cole-Cole plot is defined in a relation between reactance and resistance in a complex impedance, as shown in FIG. 5. The complex impedances of the thermistor elements 2A and 2B were measured at room temperature in the frequency range of 2-1000 KHz. Before the annealing, the Cole-Cole plots of the thermistor elements 2A and 2B were almost the same as each other, and showed nearly complete semi-arcs. After the annealing, the Cole-Cole plot of the present thermistor element 2A showed also a nearly complete semi-arc although the radius of the semi-arc increased in comparison with that of the semi-arc before the annealing. However, after the annealing, the Cole-Cole plot of the conventional thermistor element 2B was not of a semi-arc. In the higher frequency range above about 50 KHz, the Cole-Cole plot was of a nearly semi-arc, which was similar to that of the present thermistor element 2A. On the other hand, in the lower frequency range below 50 KHz, the reactance decreased slowly with an increase of the resistance and increased again in the lower frequency range below 10 KHz. This behavior suggests that the conventional thermistor element 2B after the annealing can be equivalently expressed by the circuit shown in FIG. 6. This equivalent circuit comprises a series connection of two composite circuits, each of which comprises a parallel connection of a resistor and a capacitor. When the equivalent circuit comprises one composite circuit of r and c, the Cole-Cole plot is a complete semi-arc and the maximum reactance of r/2 is obtained at the frequency of $\omega cr=1$, where $\omega=2\pi f$ and f, c and r are frequency, capacitance, and resistance. Before the annealing, the measured Cole-Cole plots agreed with that of the one composite circuit wherein r is the resistance of the SiC film and c is the capacitance between the comb-shaped electrode film 22A or 22B formed on the alumina substrate.

When the equivalent circuit comprises the series connection of the two composite circuits, the Cole-Cole plot shows a composite curve of two semi-arcs, each of which corresponds to each of the two composite circuits. One of the two composite circuits comprises a parallel connection of r' and c'. The other comprises another parallel connection of r' and c'. When the relation is $cr << c'r'$, the Cole-Cole plot depends on c and r in the higher frequency range and depends on c' and r' in the lower frequency range. It appears that the composite circuit of c' and r' was formed during the annealing. It is attributed to the composite circuit of c' and r' that the reactance increased again below 10 KHz in the Cole-Cole plot of the conventional thermistor element 2B. On the other hand, when the contact portion between the conventional Au-Pt fired electrode film 22B and the SiC film 23B of the conventional thermistor element 2B after the annealing was lightly rubbed by an insulator such as alumina, the resistance decreased by several tens percent. Such resistance decrease indicates that the composite circuit of c' and r' may correspond to an interface impedance between the SiC film 23B and the conventional Au-Pt fired electrode film 22B.

These facts suggest that the conventional Au-Pt fired electrode film 22B aggregates easily during the annealing and, as a result, there may be formed the interface impedance, which increases the resistance and decreases the B constant. On the other hand, since the Au-Pt fired electrode film 22A according to the present invention aggregates to a very small extent during the annealing by the addition of oxide, the interface impedance is not formed, whereby the thermal stability of the present thermistor element 2A is improved.

Subsequently, life tests were carried out at high temperatures of 400° C., 500° C. and 600° C. in air to find the practical operating temperature. There were used the practical SiC thin film thermistors 1A and 1B, which employed the present thermistor element 2A and the conventional thermistor element 2B, respectively. In the tested practical thermistor, Pt wires were welded to the thermistor element 2 and a glass layer 4A having the transition temperature of about 660° C. was formed. The conventional practical thermistor 1B showed the resistance change $(\Delta r/r)<\pm 5\%$ and the B constant change $(\Delta B/B)<\pm 2\%$ after the test at 400° C. for 1000 hours, $\Delta r/r>10\%$ and $\Delta B/B<-5\%$ after the test at 500° C. for 100–200 hours and $\Delta r/r>50\%$ and $\Delta B/B<-10\%$ after the test at 500° C. for 1000 hours. However, the present practical thermistor 1A shows $\Delta r/r<\pm 5\%$ and $\Delta B/B<\pm 2\%$ after the test at 500° C. for 1000 hours and after the test at 600° C. for 100 hours. These results indicate that the present practical thermistor 1A can operate at 500° C.

The present practical thermistors 1A using the Au-Pt fired electrode film 22A, wherein the mixtures of Ca oxides and Ti oxides were added at various contents in weight, were tested at 500° C. in air. The results are summarized in Table 1 below. It is preferable that the contents of the mixture are in the range between 0.01–0.1 wt %.

TABLE 1

Effect by Addition of Oxides

| Kinds of added oxides | Amounts of added oxides | Test by leaving samples in air at 500° C. Time elapsed | Resistance var. rate | B constant var. rate |
|---|---|---|---|---|
| Ca oxide + Ti oxide | 0 | 100–200 hrs. | >10% | <−5% |
| | 0.01 | 1000 hrs | <±5% | <±2% |
| | 0.1 | 1000 hrs | <±5% | <±2% |
| | 1 | 100–200 hrs. | >10% | <−5% |

(1)Added amount of oxide (wt %) = (weight of added oxide) / (weight of Au fine particle + weight of Pt fine particle) Weight of Au fine particle: weight of Pt fine particle = 3:7

The practical thermistors 1A using the present Au-Pt fired electrode film 22A, which included various ratios of Au/Pt in weight with the condition of a given addition of 0.1 wt % of the mixture, were also tested at 500° C. in air. The results are summarized in Table 2 below.

TABLE 2

Effect of (Au:Pt) Weight Ratio

| Au:Pt (weight ratio) | Test results by leaving samples in air at 500° C. Time elapsed | Resistance var. rate | B constant var. rate |
|---|---|---|---|
| 10:0 | 100–200 hrs | >20% | <−5% |
| 4:6 | 1000 hrs | <±5% | <±2% |
| 3:7 | 1000 hrs | <±5% | <±2% |
| 2:8 | 1000 hrs | <±5% | <±2% |
| 1:9 | 1000 hrs | <±5% | <±2% |
| 0:10 | 100–200 hrs. | >10% | <−5% |

It was found that the practical thermistors 1A' using the fired electrode film 22A' of a single metal such as Au or Pt were poor in thermal stability. However, those practical thermistors 1A using the electrode film 22A of a metal mixture of Au-Pt were good. The reason why the present practical thermistor element 1A using the electrode film 22A of the metal mixture of Au-Pt was good in thermal stability is not clear in detail. However, it appears that the good thermal stability is deeply related to the existence of two phases ($\alpha 1$, $\alpha 2$) in binary alloy of Au and Pt. It was reported by Dr. Max Hansen in "Constitution of binary alloy" (pp226–229) published by McGraw-Hill Book Co. in 1958 that the two phases ($\alpha 1$, $\alpha 2$) exist at least over a temperature of 600° C. Two phases prevent each phase from aggregating thermally and separately. Since oxides are added in the Au-Pt fired electrode film 22A according to the present invention, the thermal aggregation is more difficult. On the other hand, since the single metal has a single phase, its thermal aggregation is very easy. Even if oxides are added, the addition can not effectively prevent the single metal from aggregating thermally. These facts suggest that the preferable ratio of Au/Pt is ranged in the scope of the existence of two phases.

In the description hereinbefore, a mixture of Ca oxides and Ti oxides was used as an added oxide. A single addition of Ca oxide or Ti oxide was also effective.

Leads 3A were usually welded to the Au-Pt fired electrode film 22A by welding. Pt wire in a small diameter is preferable as leads 3A among various wires such as Au wire, Al wire, Pt wire and others. Au wire is easily cut off around the welded neck because of its poor mechanical strength. Since Al wire has a low melting temperature of about 660° C., it can not resist a high temperature about 700° C., whereat the glass layer 4 is formed. On the other hand, Pt wire is preferable as leads 3A because of its high mechanical strength and high melting temperature of about 1770° C.

Pt wire of 0.1–0.2 mm in diameter is preferable. The Au-Pt fired electrode film 22A is very small in heat capacity because of its thin thickness of 10–20 μm. When there is a large difference in heat capacity between the Au-Pt fired electrode film 22A and Pt wire, they are difficult to be welded. This face suggests that a fine Pt wire is preferable. However, when Pt wire is less than 0.1 mm in diameter, it is difficult to be handled and easily cut off. Considering these facts, Pt wire 3A of 0.1–0.2 mm in diameter as stated above is preferable.

The protective glass layer 4A is required to be stable at least above the operating temperature. Accordingly, it is preferable to have a transition temperature higher than 500° C. and substantially the same thermal expansion coefficient as that of the insulating substrate 21A. When an alumina substrate 21A having a thermal expansion coefficient of about $70\times10^{-7}$/°C. is used, the thermal expansion coefficient of the protective glass layer 4A should preferably be ranged between $(60\text{–}80)\times10^{-7}$/°C. Since the thermal expansion coefficient of the protective glass layer 4A is about constant at temperatures below the transition temperature, the protective glass layer 4A is stable to thermal heat shock when the thermal expansion coefficient of the protective glass layer 4A is substantially the same as that of the insulating substrate 21A. There are various low melting temperature glasses comprising various mixtures of $SiO_2$, CaO, BaO, ZnO, $B_2O_3$, PbO, $Al_2O_3$ and other oxides. Among these various glasses, the mixture comprising CaO, BaO, $SiO_2$, $B_2O_3$, and $Al_2O_3$ is preferable as the protective glass layer 4A. The present practical thermistor 1A using the preferable glass showed $\Delta r/r<5\%$ and $\Delta B/B<\pm2\%$ after the heat shock test of 1000 cycles between 500° C. and room temperature.

In the course of manufacturing the practical thermistor 1A of the present invention, the thermistor element 2A is handled by tweezers of stainless steel. For example, when Pt wire 3A was welded, the surface of the thermistor element 2A was rarely scratched by the tweezers. When the practical thermistor 1A of the present invention is constituted by such a thermistor element 2A as scratched by the metallic tweezers during manufacture, the practical thermistor 1A showed $\Delta r/r=-5\%\sim-20\%$ in spite of $\Delta B/B<\pm2\%$ after the test at 500° C. for 100–300 hours in air. This resistance decrease is considered to be attributable to the fact that the metal atoms adhering to the surface differs thermally into the SiC film 23A.

It was found that this resistance decrease was stabilized by a post-annealing after manufacturing because the decrease because saturated at a given value. A certain scratched practical thermistor 1A showed $\Delta r/r\sim-10\%$ after the test at 500° C. for about 230 hours. However, the same practical thermistor 1A showed $\Delta r/r\sim-8\%$ after the test at 500° C. for an additional period of about 700 hours. Another plurality of flawed practical thermistors 1A showed $\Delta r/r$ 5%–10% after the tests at 600° C. for 3–10 hours. However, the same plurality of practical thermistors 1A showed $\Delta r/r<\pm2\%$ after the test at 500° C. for an additional period of about 800 hours. These facts indicate that the post-annealing can stabilize the resistance decrease of the scratched practical thermistor.

It is very difficult to eliminate completely the scratched thermistor elements 2A in the manufacturing processes. This fact suggests that all of the manufactured practical thermistor 1A should preferably be processed for post-annealing. The post-annealing is preferably carried out in air because the post-annealing in vacuum or inert gases requires complex processes and special apparatuses. In addition, the post-annealing should preferably be carried out at a temperature of 500°–600° C. for 3–300 hours.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A thin film thermistor comprising:

an insulating substrate;

a Au-Pt fired electrode film formed in a comb-shaped pattern on said insulating substrate, wherein oxide is added to said electrode film in an amount of 0.01–0.1% by weight based on the sum of the weights of Au and Pt; and a SiC thin film formed by sputtering on said substrate on which said electrode film is previously formed.

2. A thin film thermistor according to claim 1, wherein said Au-Pt fired electrode film has a Au:Pt ratio which shows a two phase composition in a binary alloy formed of Au and Pt.

3. A thin film thermistor according to claim 1, wherein said oxide is a mixture of Ca oxide and Ti oxide.

4. A thin film thermistor according to claim 1, wherein said oxide is Ca oxide.

5. A thin film thermistor according to claim 1, wherein said oxide is Ti oxide.

6. A thin film thermistor according to claim 2, wherein said oxide is a mixture of Ca oxide and Ti oxide.

7. A thin film thermistor according to claim 2, wherein said oxide is Ca oxide.

8. A thin film thermistor according to claim 2, wherein said oxide is Ti oxide.

9. A thin film thermistor comprising:

an insulating substrate;

a Au-Pt fired electrode film in a comb-shaped pattern on said insulating substrate, wherein oxide except for $SiO_2$ is added to said electrode film in an amount of 0.01–0.1% by weight based on the sum of the weights of Au and Pt;

a SiC thin film formed by sputtering on said substrate on which said electrode film is previously formed;

lead wires connected to said electrode film; and a low melting temperature glass layer covering said insulating substrate on which said electrode film and said SiC film are formed.

10. A thin film thermistor according to claim 9, wherein said lead wires are Pt wires of 0.1–0.2 mm in diameter.

11. A thin film thermistor according to claim 9, wherein said low melting temperature glass layer has a transition temperature higher than 500° C. and substantially the same thermal expansion coefficient as that of said insulating substrate.

12. A thin film thermistor according to claim 9, wherein said low melting temperature glass layer comprises CaO, BaO, $SiO_2$, $B_2O_3$ and $Al_2O_3$.

* * * * *